US007122753B1

(12) United States Patent
Davis

(10) Patent No.: US 7,122,753 B1
(45) Date of Patent: Oct. 17, 2006

(54) COVER PLATE WITH FLUSH SLIDE ACTUATOR FOR ELECTRICAL DEVICES

(76) Inventor: Ralph Kenneth Davis, 1068 N. Broadway #116, Escondido, CA (US) 92026

( * ) Notice: Subject to any disclaimer, the term of this patent is extended or adjusted under 35 U.S.C. 154(b) by 36 days.

(21) Appl. No.: 11/090,884

(22) Filed: Mar. 28, 2005

(51) Int. Cl.
*H01H 3/20* (2006.01)

(52) U.S. Cl. ..... 200/331; 200/329

(58) Field of Classification Search ..... 200/329–331, 200/33 B, 339
See application file for complete search history.

(56) References Cited

U.S. PATENT DOCUMENTS

| | | | | |
|---|---|---|---|---|
| 3,816,686 | A | 6/1974 | Budd et al. | |
| 4,105,884 | A | 8/1978 | Damsky | |
| 4,427,864 | A | 1/1984 | Oster | |
| 4,760,227 | A | 7/1988 | Boxer | |
| 4,835,343 | A | 5/1989 | Graef et al. | |
| 4,914,265 | A | 4/1990 | Mongeau | |
| 4,972,045 | A | 11/1990 | Primeau | |
| 5,577,602 | A | 11/1996 | Conner et al. | |
| 5,806,665 | A | 9/1998 | Houssian | |
| 5,998,747 | A | 12/1999 | Kelso et al. | |
| 6,005,308 | A | 12/1999 | Bryde et al. | |
| 6,254,289 | B1 * | 7/2001 | Manabe et al. | 396/448 |
| 6,459,250 | B1 | 10/2002 | Davis | |
| 6,534,734 | B1 | 3/2003 | Davis | |
| 6,608,253 | B1 | 8/2003 | Rintz | |
| 6,710,274 | B1 | 3/2004 | Whetzel et al. | |
| 2004/0238341 | A1 * | 12/2004 | Yu et al. | 200/402 |
| 2005/0211538 | A1 * | 9/2005 | Krajci et al. | 200/547 |

FOREIGN PATENT DOCUMENTS

| | | |
|---|---|---|
| GB | 1363425 | 1/1984 |

* cited by examiner

*Primary Examiner*—Michael Friedhofer
*Assistant Examiner*—Lisa Klaus

(57) ABSTRACT

An in-wall mounted electrical actuation device is covered by a surface mountable cover plate. The cover plate provides a planar surface having a linear groove in it preferably extensive over a full length of the cover plate. Within the linear groove is an aperture. An actuator strip is slidably engaged within the linear groove, The linear strip provides a strip planar surface contiguous with the plate planar surface for thereby presenting a common planar outwardly facing surface. Inwardly protruding from the actuator strip through the aperture is an actuator finger which receives a device control for linear motion with the actuator strip relative to the cover plate so as to control the electrical actuation device.

6 Claims, 6 Drawing Sheets

COVER PLATE WITH FLUSH SLIDE ACTUATOR FOR ELECTRICAL DEVICES

BACKGROUND OF THE INVENTION

1. Cross Reference to Related Applications

This application is related to application Ser. No. 09/815,172, filed Mar. 21, 2001, entitled "Decorative Wall Plate Switch Mechanism For Operating A Toggle Switch," issued Mar. 18, 2003.

2. Field of the Invention

This invention relates generally to wall mounted electrical devices such as switches and dimmers, and more particularly to a wall mounted cover plate with a flush movable central strip for actuation of a device.

3. Description of Related Art

Wall switches and their cover plates are available in a range of sizes, types and designs. Typically, these switches are mounted onto walls for easy access to those devices connected to an electrical source. Such mounting is achieved by running power lines to utility boxes mounted to wall structures adjacent to the wall surface. Such boxes are then available for receiving electric switches, typically of the toggle type, whereby the switches are mechanically mounted to the box and wired to the power lines. The switch and utility box with its wires are then covered by a wall mounted cover plate, generally ivory colored, with occasionally an optional dark brown or white in color, having two circular holes for locating two threaded screws and a centrally located rectangular slot to accommodate a toggle bat. A major drawback to these cover plates has been the lack of any pleasing aesthetics to the device. There have been many attempts in prior art to make the cover plate a more decorative device and retain its ease of manual manipulation, with some designs achieving success and some not. Inventions by Coles, U.S. Pat. No. 2,172,731 issued in 1939 and Coles, U.S. Pat. No. 2,571,837 issued in 1951 are good early examples of the effort directed to this quest. However, since this time many variations of the standard toggle bat cover plate have been introduced, with each design introducing a unique form of an external cover plate into the equation.

Replacement types of switches have come into the market with very good success. These may be of the ubiquitous dimmer type, actuated by either rotation or push—push of a circular knob, or sliding action of a control protruding outwardly from the cover plate, or by a "rocker" type actuator. One of the main drawbacks to all of the above switch types is that the cover plate, being under manual operation, is continually subject to dirt and grime and is particularly difficult to clean since the switch control protrudes from the cover plate so that a simple wipe with a cleanser is not effective. In close quarters such as a narrow hallway and in particular the rotary knob control of a dimmer is easily bumped and separated from its shaft and a replacement knob becomes necessary.

The prior art teaches the use of electric wall mounted controls but fails to teach a control that does not require a protruding control mechanism and that provides a planar outwardly facing surface that is easily manipulated and is easily cleaned by a simple wiping of a cleanser. The present invention fulfills these needs.

In general, this invention constitutes an improvement on the appearance, aesthetics, and manipulation of the above prior art wall mounted switching devices.

The following art defines the present state of this field and each disclosure is hereby incorporated herein by reference.

Davis, U.S. Pat. No. 6,459,250, discloses a circuit board that provides a first elevation adapted for printing and bonding of conductor and resistor traces and monolithic ceramic capacitors, and provides through holes adapted for locating conductors. A second elevation is adapted for location and containment of a semiconductor quadrac. A third elevation is adapted for location and containment of a circuit board which is selectively adjustable through an R-C network coupled between the semiconductor quadrac and an input power source. An electric phase control uses mechanical movement for actuation. Provision is provided for mounting the phase control mechanism and the circuit so as to be manually accessed. A planar switch cover plate is adapted for sliding engagement, in parallel juxtaposition, with the mounting devices, the switch cover plate further adapted for engagement with the phase control mechanism for actuation through sliding engagement.

Davis, U.S. Pat. No. 6,534,734, discloses an electric switch requiring mechanical movement for actuation is mounted to a surface mountable switch mounting plate by standoffs so as to position a toggle bat in position for actuation by a planar switch cover plate adapted for sliding engagement, in parallel juxtaposition, with the switch mounting plate. The switch cover plate is adapted for engagement with the electric switch for actuation by sliding engagement.

Budd et al, U.S. Pat. No. 3,816,686 discloses a switch operating slide member for concealing actuator arm wall mounted switches of the type generally known as toggle switches, and for imparting oscillatory or pivotal switch operating movement to the actuator arm when generally straight line movement is imparted to the slide member. The slide member is disposed in a substantially constant attitude in different positions in its sliding movement.

Damsky, U.S. Pat. No. 4,105,884 discloses a substitute toggle switch cover plate has an elongated opening within which is reciprocatively captured an actuating member having a recessed carrier portion at the inside adapted to loosely enclose the control lever of an electrical toggle switch, and a slide knob at the outside for moving the carrier member together with the toggle switch lever between "on" and "off" positions.

Oster, U.S. Pat. No. 4,427,864 discloses a functional and aesthetic switch plate providing an extension to a wall toggle switch. The switch plate not only provides a useful mechanical extension to a toggle switch, but has a sliding toggle switch lever extension member which covers its own wear marks and is of sturdy unibody construction. The sliding toggle switch lever extension member is connected to the reflecting rear surface to the base plate by sliding contact members positioned beyond the reflecting base edges to prevent chipping of the reflecting base edges.

Steinhilber et al, U.S. Pat. No. 4,731,511 discloses a decorative wall plate and slider cap assembly is described for use with subsurface mounted, toggle-type electrical switches. The assembly provides an adapter wall plate for fastening to the switch strap. A decorative wall plate is fitted over the adapter plate to cover the fastening means and to impart a design feature to the wall plate. A rectangular opening through both plates receives the toggle switch. A slider member has two barbed spring clips which interact with rail members protruding from the face of the decorative wall plate. Upper and lower fingers, projecting rearwardly from the slider member face, act as cams to move the switch toggle in the vertical direction. A decorative slider cap fits over the slider member to give a basic geometric form to the switch toggle mechanism. Ramped projection members on the respected edges of the plates permit the member to be removably fastened for easy assembly, maintenance and change.

Boxer, U.S. Pat. No. 4,760,227 discloses a sliding switch assembly which comprises a switch plate on which a toggle actuator is mounted by two sets of vertically aligned pins extending from the switch plate, vertical slots in the actuator in alignment with the two sets of vertically aligned pins and a means to retain the slots on the pins for sliding movement of the actuator on the pins. The actuator can comprise a two-piece assembly pins. The actuator can comprise a two-piece assembly comprising an actuator back plate which contacts the pins on the switch plate and an actuator element which attaches to the actuator back plate.

Mongeau, U.S. Pat. No. 4,914,265 discloses a new cover assembly for electrical fixtures in buildings allow conventional outlets and (toggle) light switches to be cheaply converted into a variety of different color designs and/or colors without changing the electrical infrastructure of the fixture. The cover assemblies comprise a cover plate with an appropriate number of orifices, each orifice being covered by a slider so that the whole cover assembly shields the conventional parts of the fixtures normally visible in building interiors.

Graef et al, U.S. Pat. No. 4.835.343 A two-piece face plate for wall mounted devices having a rectangular escutcheon is disclosed. An adapter plate having the length and width of the wall box opening is connected to the yoke of a wall box mounted device at the screw openings in the yoke plate reserved for the connection of the wall plate. Snap receiving openings are contained in the adapter plate. A decorative wall plate, which is free of mounting screw openings, has projecting snaps which project into the snap openings in the adapter plate. An internal flange extending from the wall plate produces a shadow around the periphery of the wall plate relative to the wall in which the switch is mounted. A plural gang wall box is disclosed which receives respective devices and respective adaptor plates. A common wall plate is snapped into position relative to all adaptor plates, Primeau, U.S. Pat. No. 4,972,045 discloses a structure for facilitating the gripping and operating of a control lever of an electrical switch plate mounted into an electrical box embedded into a wall. The structure comprises a movable plate having a large central projection. The projection defines a trough in which the control lever engages, and two large abutting surfaces opposite the trough and orthogonal to the wall, the plate being slidable within a plane parallel to the wall. A cover is fixedly secured to the electrical box by its square central section the plane of which is interiorly offset with respect to the main body of the cover. The central section is upwardly and downwardly open to enable sliding action of the movable plate parallel to the wall, within the plane of the cavity. Thus, the movable plate hides the control lever as well as the screws that secure the cover to the electrical box, and is retained by the guide walls of the cover. In accordance with the invention, a modular covers assembly is also provided for use with electrical plugs as well as electrical switches. These various modules are interconnected by dovetailed connectors.

Conner et al, U.S. Pat. No. 5,577,602 discloses a switch extender for electrical switches having a front plate slidably coupled to a back plate which in turn is attached to a wall mounted switch plate. The back plate includes a knock-out portion which allows use of the invention with both toggle switches and rocker switches. A pair of cylindrical bars are positioned within an opening in the front plate. A toggle switch fits within a slot between the bars, and the corners of a rocker switch fit within the slots outside of the bars on the front plate. Sliding the front plate relative to the back plate actuates the switch.

Houssian, U.S. Pat. No. 5,806,665 discloses an arcuate switch plate assembly for a standard wall toggle switch comprising a convex base plate and a convex switch actuator wherein the convex actuator moves in an arc similar to the arc of the toggle switch.

Kelso et al, U.S. Pat. No. 5,998,747 discloses a switch plate cover for an electrical toggle switch comprising three components. The first is a face plate which has an orifice and two standard screw holes for mounting the switch. The second is a shaped toggle actuator cover which fits over the toggle actuator of the switch and partially through the orifice. The third is a base plate with a rectangular orifice for passage of the toggle switch/dimmer actuator to the toggle actuator cover. The combined components of the switch plate cover are mounted onto the toggle actuator of an electrical switch by placing the orifice of the third component and the hollow vertical second component directly on top of the toggle actuator and then affixing the combined face plate assembly to the switch plate with screws. In operation, the second component is slid up or down, such that the above mentioned-rectilinear displacement causes the actuator to move from one of its positions to the other of its positions.

Bryde et al, U.S. Pat. No. 6,005,308 discloses an electrical switch and dimmer device for controlling current applied to a load comprises a bezel assembly which includes a bezel housing, a switch actuator, and a dimmer actuator. The bezel housing supports both switch and dimmer actuators for respective movement between first and second positions, whereby the on/off state of an electrical switch adapted to apply power to an electrical load (e.g. an electric light or fan) is controllable, as is the level of power applied to the load by the switch. The bezel housing and the switch/dimmer actuators, which it supports comprise a self-contained assembly which can be releasably connected to a yoke member on which an electrical switch and dimmer circuitry are mounted. Preferably, the switch actuator comprises a paddle-type actuator which is pivotally mounted between a pair of opposing side walls of the bezel housing, and the dimmer actuator comprises a slidably mounted member which is guided by a rectilinear slot formed in one of the bezel walls adjacent an edge of the paddle actuator.

Rintz, U.S. Pat. No. 6,608,253 A light switch cover is disclosed for use with conventional "rocker" and "toggle" type switches. The cover generally includes a mounting bracket which is attached to the electrical box, along with the switch and a face plate which is attached to the mounting bracket. For "rocker" type switches, the face plate is preferably constructed from a soft material to allow the user to operate the covered "rocker" switch, but can be made of a combination of hard and soft materials. For "toggle" type switches an aperture is provided in the face plate to operate the toggle. Preferably, the outer surface of the face plate is provided with a decorated design or other indicia. The light switch can also be utilized where more than one switch is provided. For multiple "rocker" switches, a diverter bar is provided on the mounting bracket, to absorb pressure being asserted on one "rocker" switch from also transferring to an adjacent "rocker" switch and inadvertently turning "off" or "on" the adjacent "rocker" switch. An inner or sub-frame can be provided to allow for an outer frame of any shape with a standard shaped mounting bracket. This assembly includes an outer frame, a flexible decorative sheet, an inner/sub frame and a mounting bracket. The cover assembly completely covers a switch assembly, while allowing the switch assembly to be operated while covered.

Whetzel et al, U.S. Pat. No. 6,710,274 discloses a switch actuator acts in combination with a conventional light switch having a toggle switch arm mounted in a base such that when the toggle switch pivots from a first position to a second position, electrical contacts in the base are moved from a contacting condition to a non-contacting condition or vice versa. The decorative switch actuator has a face plate, an actuating assembly, and a cap assembly. The actuating assembly is mounted on the face plate, and has a means for receiving the toggle switch arm such that a linear movement of the receiving means moves the toggle switch arm from the first to the second position or vice versa. The cap assembly is mounted on the faceplate, and is structurally independent of the actuator.

The prior art teaches the use of electric wall mounted controls such as: a decorative wall plate switch dimmer mechanism and a decorative wall plate mechanism for operating a toggle switch, slide actuators for toggle switches, toggle switch extenders, decorative wall plates and slider caps for toggle switches, sliding switch covers, face plates and cover plates for wall box devices, arcuate switch covers, switch plate assemblies, switch and dimmer control devices, switch actuators; but fails to teach a two-piece cover plate, one piece movable, with a planar outward facing surface that is as stable and permanently mounted as the prior movable flat cover plates.

SUMMARY OF THE INVENTION

The present invention teaches certain benefits in construction and use which gives rise to the objectives described below.

In the preferred embodiment of the invention, an in-wall mounted electrical actuation device is covered by a two-piece surface mountable cover plate. The cover plate provides a planar surface having a linear groove in it preferably extensive over the full length of the cover plate. Within the linear groove is a rectangular shaped aperture. An actuator strip is slidably engaged within the linear groove. The linear strip provides a planar surface contiguous with the plate planar surface for thereby presenting a common planar outwardly facing surface. Inwardly protruding from bottom side of the actuator strip through the aperture is a flexible actuator finger which receives a slidable device control for linear motion with the actuator strip relative to the cover plate so as to control the electrical function of the device. The flexible actuator finger mated to the slidable device control are coupled so as being easily capable of a multiplicity of engagements and disengagements either for decorative purposes and/or maintenance purposes.

A primary objective of the present invention is to provide an apparatus and method of use of such apparatus that yields advantages not taught by prior art.

Another objective of the invention is to provide a two-piece lower profile planar surface wall mounted switching device that can be of a single color or can comprise a surface of multiple choices of different aesthetic colors.

Another objective of the invention is to provide a lower profile flat switching device having a planar surface with no protruding elements so that it is easily cleaned.

Another objective of the invention is to provide a lower profile switching device that is not easy to be damaged by inadvertently rubbing or bumping against it.

A still further objective of the invention is to provide a lower profile flat switch plate that is easily mounted to a switch mechanism within a switch box.

A further objective is to provide this invention as a high quality wall mounted dimmer switch for lighting.

Another objective is to provide this invention as a high quality wall mounted switching device for control of a variety of "on-off" switching applications.

Further, the present invention provides an advantage over prior flat surface switch plates in that the entire plate does not move in affecting a switching or dimming function, but only a central strip that enables the device to be more rugged in use.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

FIRST EMBODIMENT

The above described drawing figures illustrate the present invention in several of its preferred, best mode embodiments, which are further defined in detail in the following description. Those having ordinary skill in the art may be able to make alterations and modifications in the present invention without departing from its spirit and scope. Therefore, it must be understood that the illustrated embodiments have been set forth only for the purpose of example and that they should not be taken as limiting the invention as defined in the following.

Figure 1:
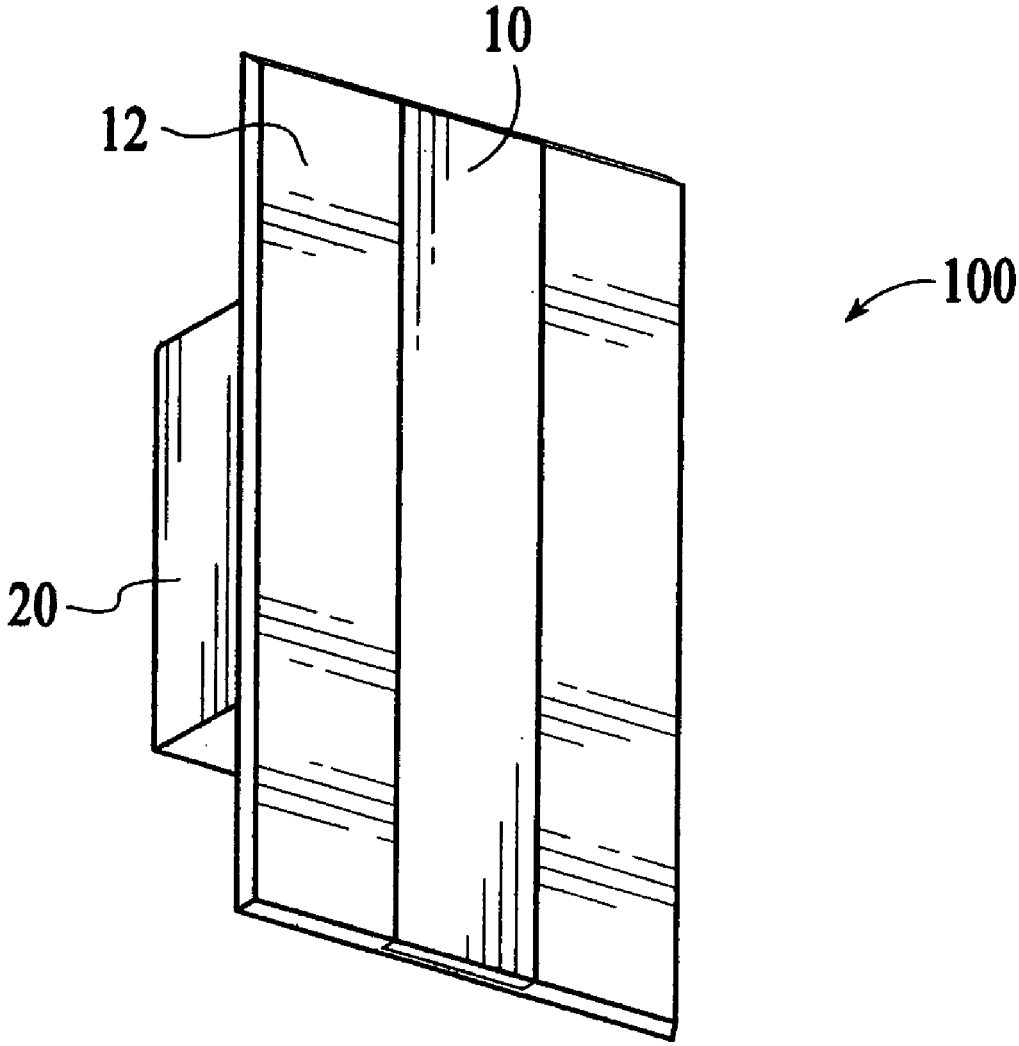
FIG. 1 is a side elevation view of the present invention.
Figure 2:
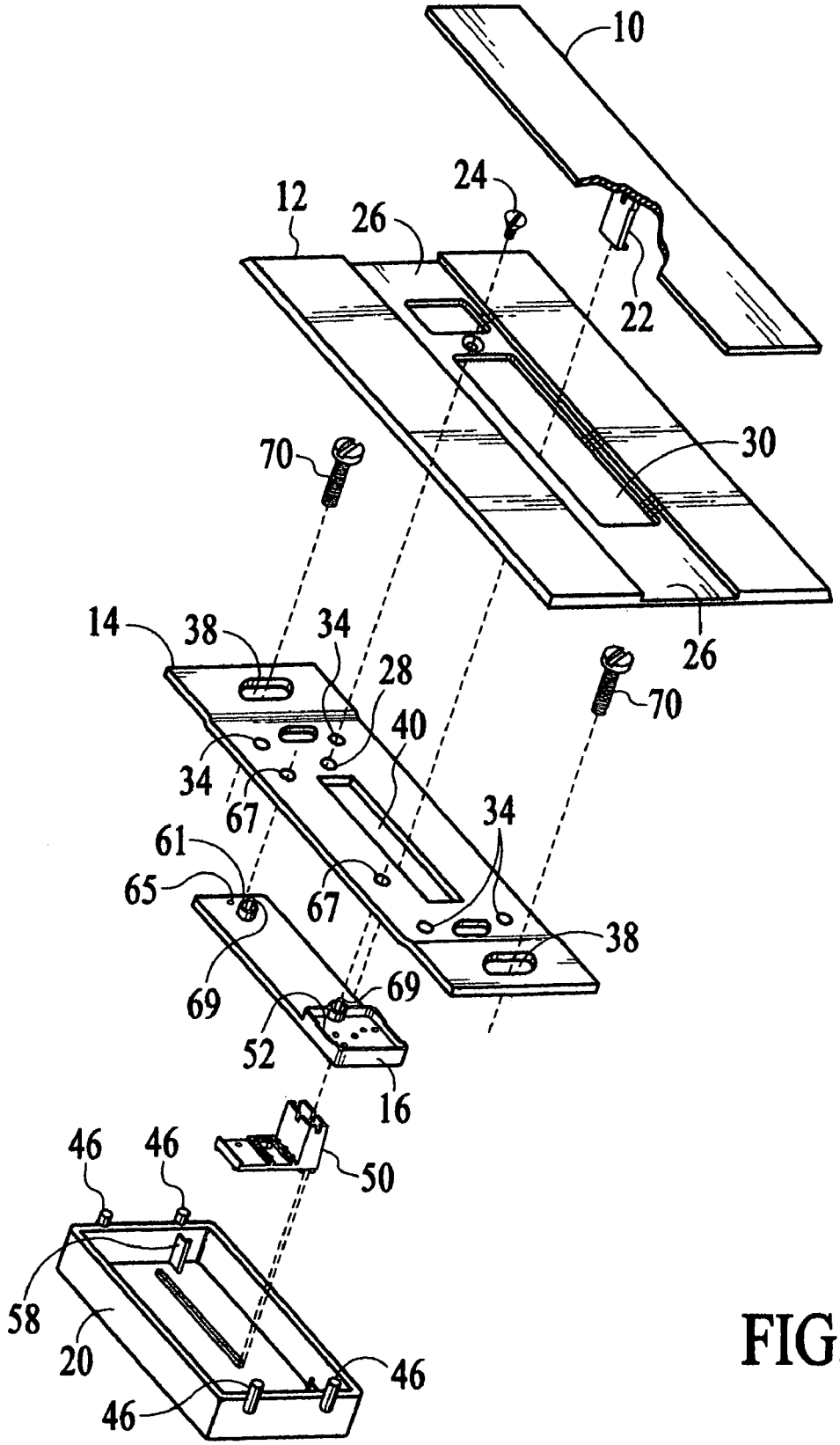
FIG. 2 is a perspective exploded view thereof.

In one embodiment of the present invention apparatus a mountable cover plate 12, as shown in FIGS. 1 and 2, providing a plate having an outer planar surface and a linear groove 26 therein, and within the linear groove a rectangular aperture 30 (FIG. 2). An actuator strip 10 is slidably engaged within the linear groove 26, the actuator strip 10 providing a strip outer planar face contiguous with the outer planar surface of mountable cover plate 12 (FIGS. 1 & 2) for thereby presenting a common planar outwardly facing surface which is a combination of surfaces 10 and 12. On the opposing side of actuator strip 10, an inwardly extending finger 22 in the form of a cantilever lug is attached for coupling with a slidable potentiometer control device 50, the latter being useful for establishing linear mechanical motion for control of an electrical device (not shown) as the actuator strip 10 slides relative to the mountable cover plate 12. (FIGS. 1 & 2)

The following illustrate the invention in at least one if its preferred embodiments, which is further defined in detail in the following description in its use as a dimmer switch.

Figure 3:
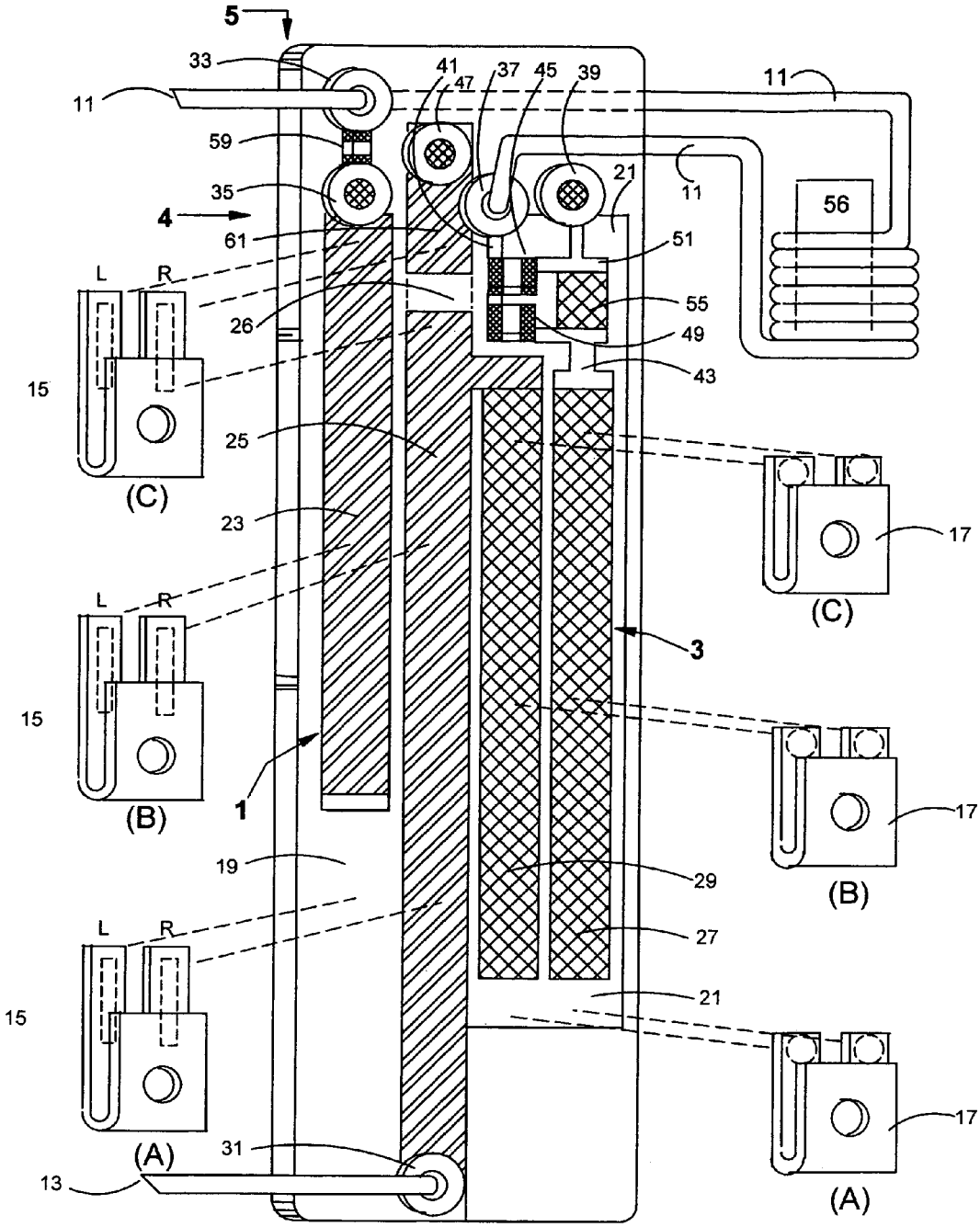
FIG. 3 is a plan view of a thermoplastic circuit board showing R-C network components corresponding thereto.
Figure 6:
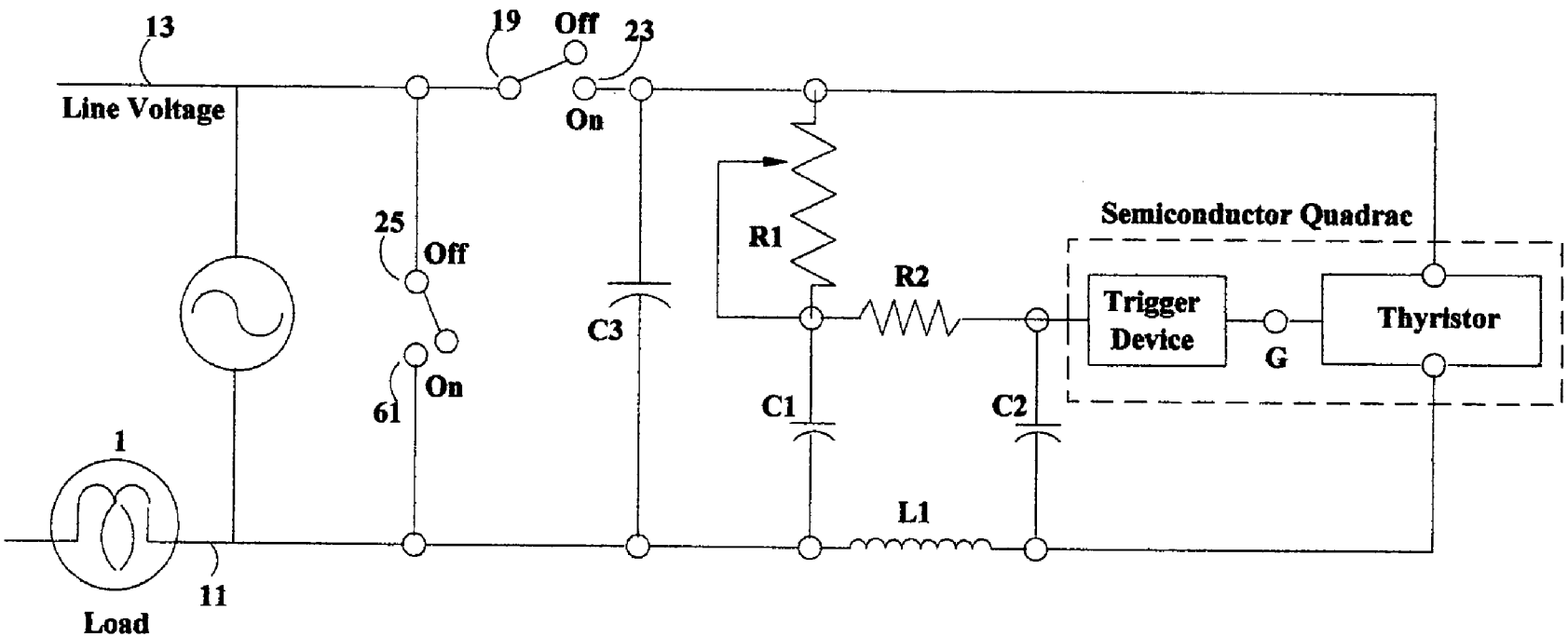
FIG. 6 is an electrical schematic diagram of a dimmer switch circuit.

FIGS. 1 and 2 show an adjustable wall mounted switching device 100 with a two-piece switch cover plate 10 and 12, section 10 movable, section 12 to be mounted permanent to a wall surface by use of a mechanical screw, with both cover plates providing a flat planar surface on the outer side. Movable plate 10 provides on its bottom side an attached an inwardly extending finger 22 in the form of a cantilever lug. Switching device 100 is permanently affixed to a standard electrical junction box to which a source of electrical power is connected. An incandescent lighting load 1 as shown in FIG. 6 is wired in series with the adjustable power control by attachment to conductor elements 11 and 13 as shown in FIG. 3. The power control device 100 enables the magnitude of power provided to lighting load 1 to be selectively varied. FIG. 3 shows a circuit assembly 5 contained on a rectangular shaped thermoplastic circuit board 16. Circuit board 16 provides a first elevation for containing through holes for eyelet vias 31, 33, 35, 37, 39, and 47, a second elevation for containing flat metallic conductors 23, 25, and 61. The eyelets serve as terminals for conductors 11, 13, and terminals for semiconductor quadrac 52 (not shown in FIG. 3) and thus comprise a circuit means 4 to furnish a selectively adjustable phase shifting R-C network coupled between semiconductor quadrac 52 and power sources 11 and 13. The circuit means 4 furnishes a selectively adjustable phase shifting R-C network for controlling the point in the cycle of applied line voltage to which a positive or negative pulse is applied to effect the applied voltage and thereby controlling the power applied to load 1.

The selectively variable circuit function is provided by metallic spring wipers 15 and 17 contained in sliding potentiometer control element 50, as shown in FIG. 2, coupled to actuator strip 10 by the engagement of an inwardly extending finger 22 in the form of a inwardly extending finger 22 in the form of a cantilever lug into the adapted sliding potentiometer element 50 to comprise an industrial connection well known as a snap fit, thus establishing a physical connection that may be made and unmade multiple numbers of times.

Sliding potentiometer element 50 is held in a permanent spatial alignment between housing 20 and circuit board 16 by forced spring tension of the wipers 15 and 17, and in its X and Y axis by slot 40 in aluminum yoke 14. As cover plate 10 is at its lowest vertical position "A", as shown in FIGS. 1 and 3, spring wiper 15 is in contact with conductor element 25 only, comprising an open circuit and thus no power is delivered to the circuit. As spring wiper 15 is moved and crosses area 19, it contacts conductor element 23, the circuit is closed and voltage is applied to the circuitry, initiating the "ON" position of an air gap switch. Spring wiper 17 contacts resistor traces 27 and 29, and a very low level of illumination is achieved. As spring wiper 17 is varied in its position on resistor trace 27 and 29, (section "B", FIG. 3), the resistance component in the R-C phase control network 4 is changed and thus the illumination level changes. As spring wiper 15 and 17 are moved further along their respective traces spring wiper 15 crosses and straddles air gap 26 and contacts conductor element 61, (position 'C', FIG. 3). This shorts conductor elements 23, 25, and 61, shunting the input voltage from the R-C network 4 directly to conductors 11 and 13, supplying full voltage to load 1 for maximum illumination. As spring wiper 15 is moved from position "C" downward to position "A" and contacts area 19, the circuit opens and forms the "OFF" position of an air gap switch. The sliding potentiometer control element 50 makes an electrical contact with an electrical circuit in a manner taught in my prior patent, Davis, U.S. Pat. No. 6,459,250 herein incorporated by reference. Thus, the sliding motion of actuator strip 10 provides an elegant and effective means for controlling an electrical device without moving the entire cover plate as has been disclosed in the prior art of record in Davis, U.S. Pat. No. 6,459,250. The present invention also provides a lower cost assembly process over that used in prior art wall mounted dimmer switches. Circuit board 16 is attached to aluminum yoke 14 by inserting studs 69 through holes 67 of the yoke and permanently affixed to each other by ultrasonic welding. The same method is used for a permanent connection of housing 20 to yoke 14. Studs 46 of housing 20 are mated with holes 34 of yoke 14 for the ultrasonic process.

In this dimmer switch embodiment the invention provides a thermoplastic circuit board with five separate elevations; a surface elevation for eyelet vias, a cavity for containing flat metallic conductors, another cavity for containing printed conductor traces, resistor traces, and monolithic ceramic capacitors, a wall structure for locating semiconductors, and studs for attachment to a metal plate. Along with a housing with plastic studs for attachment to a metal yoke, these separate elevations comprise a connection method of achieving both lower component and labor costs to produce a quality dimmer switch device with unique aesthetics not found in prior art devices.

SECOND EMBODIMENT

The following illustrate the invention in at least one if its preferred embodiments, which is further defined in detail in the following description in its use as a slide switch for a variety of "ON-OFF" switching applications.

FIGS. 1 and 2 show an adjustable wall mounted switching device 100 with a two-piece switch cover plate 10 and 12, section 10 movable, section 12 to be mounted permanent to a wall surface by use of a mechanical screw, with both cover plates providing a flat planar surface on the outer side. Movable plate 10 provides on its opposing side a protruding finger 22 in the form of a flexible cantilever lug. Switching device 100 is permanently affixed to a standard electrical junction box to which a source of electrical power is connected.

Figure 4:
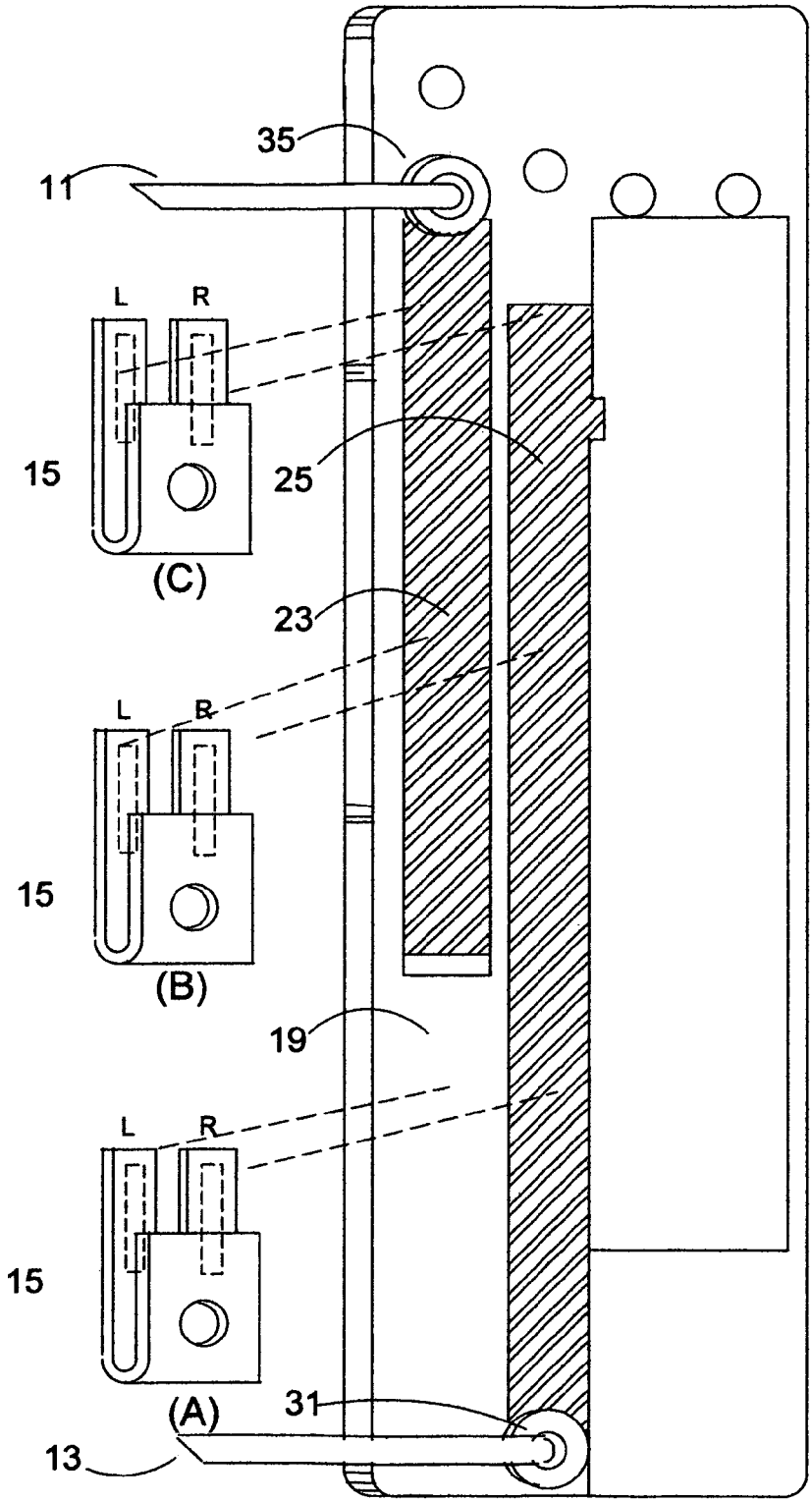
FIG. 4 is a plan view of a thermoplastic circuit board showing air gap switch components thereto.
Figure 5:
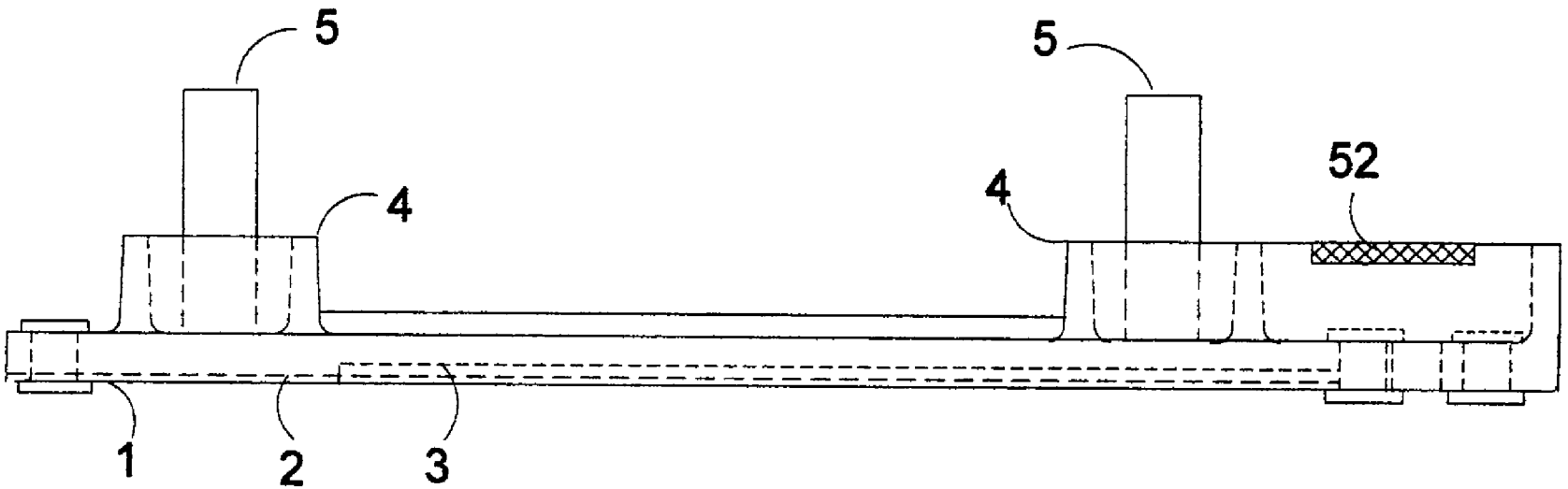
FIG. 5 is a side view of a thermoplastic circuit board showing multiple elevations thereto.

Switching device 100 is wired in series with an electrical load such as an electric light as shown in FIG. 6 and/or any other electrical device that operates only in the fully "ON" or fully "OFF" mode. FIG. 4 shows a thermoplastic circuit board 16 that utilizes three of five elevations: a first elevation for containing through holes for eyelet vias 31 and 35, a second elevation for containing flat metallic conductors 23 and 25. The eyelets 31 and 35 serve as terminals for conductors 11 and 13 wired in series with an appropriate load.

The selectively on-off circuit function is provided by metallic spring wiper 15 as shown in FIG. 3 contained in sliding potentiometer control element 50, as shown in FIG. 2, coupled to actuator strip 10 by the engagement of an inwardly extending finger 22 in the form of a cantilever lug into the adapted sliding potentiometer control element 50 to comprise an industrial connection well known as a snap fit, thus establishing a physical connection that may be made and unmade multiple numbers of times. Sliding potentiometer control element 50 is held in a permanent spatial alignment between housing 20 and circuit board 16 by forced spring tension of the wiper 15, and in its X and Y axis by slot 40 in aluminum yoke 14. As cover plate 10 is at its lowest vertical position "A", as shown in FIG. 4, spring wiper 15 is in contact with conductor element 25 only, comprising an open circuit and thus no power is delivered to the circuit. As spring wiper 15 is moved upwardly and crosses area 19, it contacts conductor element 23, the circuit is closed and voltage is applied to the circuitry, initiating the "ON" position of an air gap switch, (position "B" FIG. 4). As spring wiper 15 is moved from its upward position "C" downward to position "A" and contacts area 19, the circuit opens and forms the "OFF" position of an air gap switch.

In this on-off switching embodiment the invention provides all the plastic components as shown in FIG. 2, sans the electronic components used to comprise an adjustable R-C phase shift network.

The final assembly of this switching device utilizes the same ultrasonic welding techniques as that used in the dimmer switch application above. A thermoplastic circuit board using three of five separate elevations; a surface elevation for eyelet vias, a cavity for containing flat metallic conductors, and plastic studs for attachment to a metal plate. Along with a housing with plastic studs for attachment to a metal yoke, these separate elevations comprise a connection method of achieving both lower component and labor costs to produce a quality switching device with unique aesthetics not found in prior art switching devices.

The enablements described in detail above are considered novel over the prior art of record and are considered critical to the operation of the best mode uses of the invention and to the achievement of the above described objectives and uses The present invention is not to be limited in scope by the specific embodiments described which are intended as single illustrations of individual aspects of the invention, and functionally equivalent methods and components are within the scope of the invention. Indeed, various modifications of the invention, in addition to those shown and described herein will become apparent to those skilled in the art from the foregoing description and accompanying drawings. Such modifications are intended to fall within the scope of the appended claims.

What is claimed is:

1. An apparatus comprising: an electrical device control for engagement with an in-wall mounted electrical device requiring adjustment; a surface mountable cover plate, the plate providing a plate outer planar surface having a linear groove therein, and within the linear groove an aperture, an actuator strip slidably engaged within the linear groove, the actuator strip providing a strip outer planar surface contiguous with the cover plate outer planar surface for thereby presenting a common planar outwardly surface; and, inwardly extending from the actuator strip through the aperture, an actuating finger receiving an electrical device control in mutual engagement for linear motion with the actuator strip relative to the cover plate.

2. An apparatus comprising: a surface mountable cover plate, the plate providing a plate outer planar surface having a linear groove therein, and within the linear groove an aperture; an actuator strip slidably engaged within the linear groove, the actuator strip providing a strip outer planar surface contiguous with the plate outer planar surface for thereby presenting a common planar outwardly facing surface, and, inwardly extending from the actuator strip through the aperture, a flexible finger integral to the actuator strip in the form of a cantilever lug for achieving a snap fit engagement to a slidable control device.

3. An apparatus of claim one comprising a surface mountable cover plate, the plate providing a plate outer planar surface having a linear groove therein, and within the linear groove an aperture, an actuator strip slidably engaged within the linear groove, the actuator strip providing a strip outer planar surface contiguous with the cover plate outer planar surface for thereby presenting a common planar outwardly surface; wherein the actuator strip is easily accessible for multiple numbers of engagements or disengagements with the slidable control device either for decorative purposes or maintenance purposes.

4. An apparatus of claim one comprising a surface mountable cover plate, the plate providing a plate outer planar surface having a linear groove therein, and within the inear groove an aperture, an actuator strip slidably engaged within the linear groove, the actuator strip providing a strip outer planar surface contiguous with the cover plate outer planar surface for thereby presenting a common planar outwardly surface; wherein the cover plate and the actuator strip may be of a single color or may be a combination of multiple different colors.

5. An apparatus of claim one establishing a switching device that utilizes a thermoplastic circuit board of multiple elevations that contain the electronic circuitry that comprises that of a quality dimmer switch.

6. An apparatus of claim one establishing a switching device that utilizes a thermoplastic circuit board of multiple elevations that contain the components that comprise that of a slide switch for on-off switching applications.

* * * * *